US006918776B2

(12) United States Patent
Spink, Jr.

(10) Patent No.: US 6,918,776 B2
(45) Date of Patent: Jul. 19, 2005

(54) MEZZANINE-TYPE ELECTRICAL CONNECTOR

(75) Inventor: William E. Spink, Jr., Laguna Niguel, CA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/626,295

(22) Filed: Jul. 24, 2003

(65) Prior Publication Data

US 2005/0020103 A1 Jan. 27, 2005

(51) Int. Cl.[7] ..... H01R 12/00
(52) U.S. Cl. ..... 439/74; 439/83; 439/108
(58) Field of Search ..... 439/74, 78, 83, 439/76.1, 682, 686, 689, 108, 101

(56) References Cited

U.S. PATENT DOCUMENTS 5,174,764 A * 12/1992 Kandybowski et al. ..... 439/83
5,704,794 A * 1/1998 Lindeman ..... 439/66
6,024,584 A * 2/2000 Lemke et al. ..... 439/83
6,042,389 A 3/2000 Lemke et al. ..... 439/74
6,079,991 A 6/2000 Lemke et al. ..... 439/83
6,093,035 A 7/2000 Lemke et al. ..... 439/83
6,164,983 A 12/2000 Lemke et al. ..... 439/83
6,241,535 B1 6/2001 Lemke et al. ..... 439/83
6,319,075 B1 11/2001 Clark et al. ..... 439/825
6,325,644 B1 12/2001 Lemke et al. ..... 439/83
6,443,745 B1 * 9/2002 Ellis et al. ..... 439/101
6,699,048 B2 * 3/2004 Johnson et al. ..... 439/74
6,712,646 B2 * 3/2004 Shindo ..... 439/608
6,743,049 B2 * 6/2004 Perugini et al. ..... 439/607
6,776,629 B2 * 8/2004 Shuey ..... 439/108
6,809,537 B2 * 10/2004 Adams ..... 324/755

* cited by examiner

*Primary Examiner*—Hien Vu
(74) *Attorney, Agent, or Firm*—Woodcock Washburn LLP

(57) ABSTRACT

A preferred embodiment of a mezzanine-type electrical connector comprises a first connector half for mounting on a first circuit substrate. The first connector half comprises a first connector body and a first electrically-conductive member mounted in the first connector body for conducting electrical power from a plurality of locations on the first circuit substrate. A preferred embodiment also comprises a second connector half for mounting on a second circuit substrate and mating with the first connector half. The second connector half comprises a second connector body and a second electrically-conductive member mounted in the second connector body for conducting electrical power to a plurality of locations on the second circuit substrate. The second power contact strip contacts the first power contact strip when the first and second connector halves are mated.

19 Claims, 11 Drawing Sheets

MEZZANINE-TYPE ELECTRICAL CONNECTOR

FIELD OF THE INVENTION

The present invention relates to electrical connectors and, more particularly, to mezzanine-type electrical connectors.

BACKGROUND OF THE INVENTION

Mezzanine-type electrical connectors are typically used to electrically couple a first and a second circuit substrate. A conventional mezzanine-type connector can comprise a plug for mounting on the first circuit substrate, and a receptacle for mounting on the second circuit substrate. The plug comprises a plurality of contacts that each engage a corresponding contact on the receptacle when the plug and the receptacle are mated, thereby establishing electrical contact between the first and second circuit substrates.

The individual electrical contacts in the plug and receptacle are used to conduct electrical signals or, alternatively, electrical power. Contacts that are used to conduct electrical signals are commonly referred to as "signal contacts," and contacts that are used to conduct electrical signals are commonly referred to as "power contacts."

The amount of power that can be conducted by a mezzanine-type connector is usually limited by the configuration of the power contacts, e.g., by the overall number, size, shape, density, etc. of the power contacts. Subjecting the power contacts to an excessive power input can overheat and damage the power contacts and the surrounding structure of the connector. The problem of potential overheating can be exacerbated by the relatively high-densities in which the power contacts of many contemporary mezzanine-type connectors are packaged.

SUMMARY OF THE INVENTION

A preferred embodiment of a mezzanine-type electrical connector comprises a first connector half for mounting on a first circuit substrate. The first connector half comprises a first connector body and a first electrically-conductive member mounted in a slot formed in the first connector body for conducting electrical power. The first electrically-conductive member comprises a body portion, attachment features electrically and mechanically coupled to the body portion for electrically and mechanically coupling the first electrically-conductive member to a plurality of locations on the first circuit substrate, and mating features electrically and mechanically coupled to the body portion.

A preferred embodiment also comprises a second connector half for mounting on a second circuit substrate and mating with the first connector half. The second connector half comprises a second connector body and a second electrically-conductive member mounted in a slot formed in the second connector body for conducting electrical power. The second electrically-conductive member comprises a body portion, attachment features electrically and mechanically coupled to the body portion of the second electrically-conductive member for electrically and mechanically coupling the second electrically-conductive member to a plurality of locations on the second circuit substrate, and mating features electrically and mechanically coupled to the body portion of the second electrically-conductive member. The mating features of the second electrically-conductive member engage the mating features of the first electrically-conductive member when the first and second connector halves are mated.

A preferred embodiment of a connector system for electrically coupling a first and a second circuit substrate comprises a receptacle for mounting on the first circuit substrate. The receptacle comprises a receptacle body, a first power contact strip mounted in the receptacle body for electrically contacting a first plurality of electrical contact points on the first circuit substrate and conducting electrical power, and a first plurality of signal contacts mounted in the receptacle body for electrically contacting a second plurality of electrical contact points on the first circuit substrate and conducting electrical signals.

A preferred embodiment also comprises a plug for mounting on the second circuit substrate and mating with the receptacle. The plug comprises a plug body, a second power contact strip mounted in the plug body for electrically contacting a first plurality of electrical contact points on the second circuit substrate and conducting electrical power, and a second plurality of signal contacts mounted in the plug body for electrically contacting a second plurality of electrical contact points on the second circuit substrate and conducting electrical signals. The first power contact strip contacts the second power contact strip and each of the first plurality of signal contacts contacts a respective one of the second plurality of signal contacts when the receptacle and the plug are mated.

Another preferred embodiment of a connector system for electrically coupling a first and a second circuit substrate comprises a receptacle for mounting on the first circuit substrate and comprising a receptacle body and a first power contact strip mounted in a slot formed in the receptacle body for conducting electrical power. The first power contact strip comprises a body portion, a plurality of attachment tabs adjoining the body portion for being electrically and mechanically coupled to respective electrical-connection pads on the first circuit substrate, and plurality of mating tabs adjoining the body portion.

A preferred embodiment also comprises a plug for mounting on the second circuit substrate and mating with the receptacle. The plug comprises a plug body and a second power contact strip mounted in a slot formed in the plug body for conducting electrical power. The second power contact strip comprises a body portion, a plurality of attachment tabs adjoining the body portion of the second power contact strip for being electrically and mechanically coupled to respective electrical-connection pads on the second circuit substrate, and a contact blade adjoining the body portion of the second power contact strip. The mating tabs engage the contact blade when the plug and the receptacle are mated.

Another preferred embodiment of a mezzanine-type electrical connector comprises a first connector half for mounting on a first circuit substrate. The first connector half comprises a first connector body and a first electrically-conductive member mounted in the first connector body for conducting electrical power from a plurality of locations on the first circuit substrate.

A preferred embodiment also comprises a second connector half for mounting on a second circuit substrate and mating with the first connector half. The second connector half comprises a second connector body and a second electrically-conductive member mounted in the second connector body for conducting electrical power to a plurality of locations on the second circuit substrate. The second power contact strip contacts the first power contact strip when the first and second connector halves are mated.

Another preferred embodiment of a mezzanine-type electrical connector comprises a first connector half mounted in the first circuit substrate. The first connector half comprises a first connector body, and a first power contact strip mounted in the first connector body and comprising a plurality of tabs for conducting electrical power from respective electrical-connection pads on the first circuit substrate by way of solder connections formed between each of the plurality of tabs and the respective electrical-connection pads.

A preferred embodiment also comprises a second connector half mounted in the second circuit substrate for mating with the first connector half. The second connector half comprises a second connector body, and a second power contact strip mounted in the second connector body and comprising a plurality of tabs for conducting electrical power to respective electrical-connection pads on the second circuit substrate by way of solder connections formed between each of the plurality of tabs of the second power contact strip and the respective electrical-connection pads on the second circuit substrate. The second power contact strip contacts the first power contact strip when the first and second connector halves are mated.

A preferred embodiment of an electrical device comprises a first circuit substrate, a second circuit substrate, and an electrical connector system. The electrical connector system comprises a first connector half mounted in the first circuit substrate. The first connector half comprises a first connector body, and a first power contact strip mounted in the first connector body and comprising a plurality of tabs for conducting electrical power from respective electrical-connection pads on the first circuit substrate by way of solder connections formed between each of the plurality of tabs and the respective electrical-connection pads.

The electrical connector system of a preferred embodiment also comprises a second connector half mounted in the second circuit substrate for mating with the first connector half. The second connector half comprises a second connector body, and a second power contact strip mounted in the second connector body and comprising a plurality of tabs for conducting electrical power to respective electrical-connection pads on the second circuit substrate by way of solder connections formed between each of the plurality of tabs of the second power contact strip and the respective electrical-connection pads on the second circuit substrate. The second power contact strip contacts the first power contact strip when the first and second connector halves are mated.

BRIEF DESCRIPTION OF THE DRAWINGS

The foregoing summary, as well as the following detailed description of a presently-preferred embodiment, is better understood when read in conjunction with the appended drawings. For the purpose of illustrating the invention, the drawings show an embodiment that is presently preferred. The invention is not limited, however, to the specific instrumentalities disclosed in the drawings. In the drawings.

DESCRIPTION OF PRESENTLY-PREFERRED EMBODIMENTS

FIGS. 1 to 9 depict a mezzanine-type electrical connector 10 for electrically coupling a first and a second circuit substrate, such as a printed-circuit board (PCB) 12 and a second PCB 14. It should be noted that use of the electrical connector 10 in conjunction with the PCBs 12, 14 is disclosed for exemplary purposes only. The electrical connector 10 can be used to electrically couple other types of circuit substrates.

The electrical connector 10 comprises a first connector half, and a second connector half for mating with the first connector half. The first connector half can be, for example, a receptacle 16, and the second connector half can be, for example, a plug 18.

Figure 6:
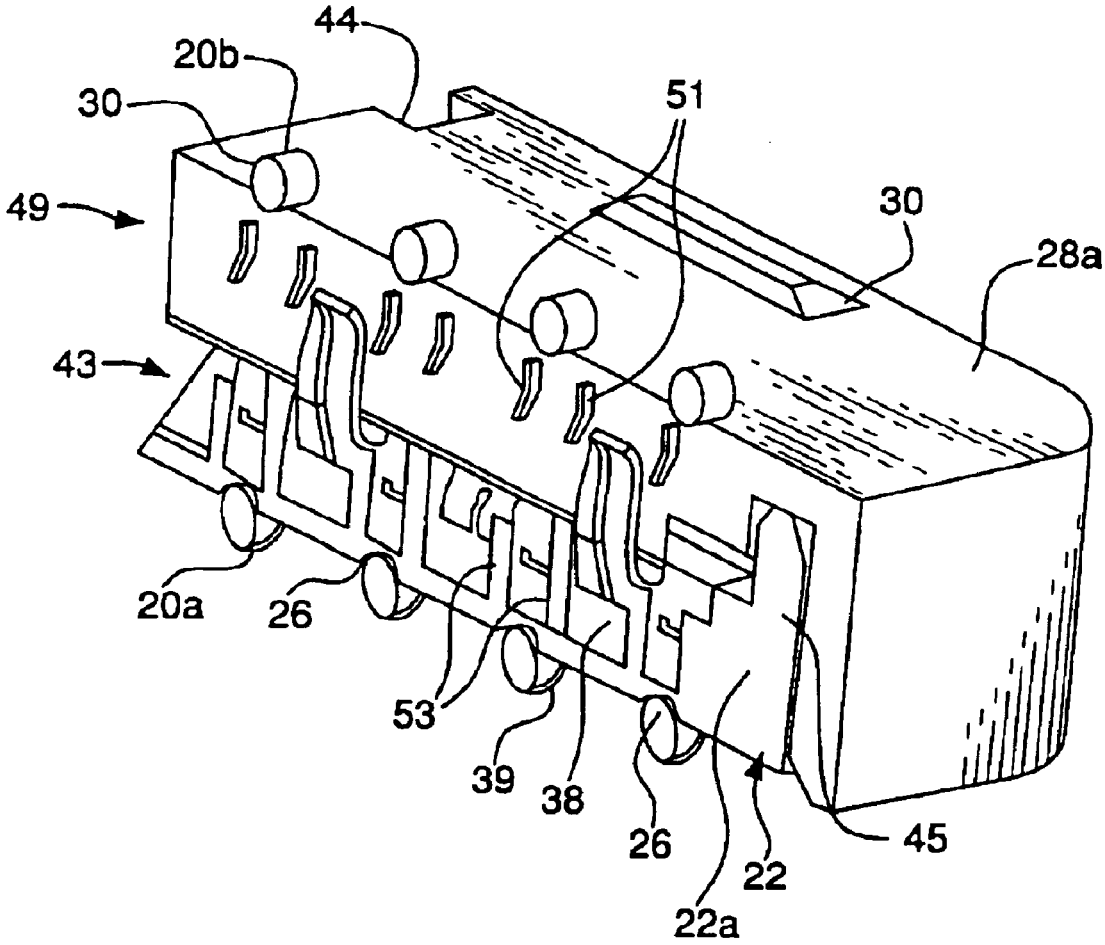
FIG. 6 is a cross-sectional view of the area designated "C" in FIG. 1.
Figure 9:
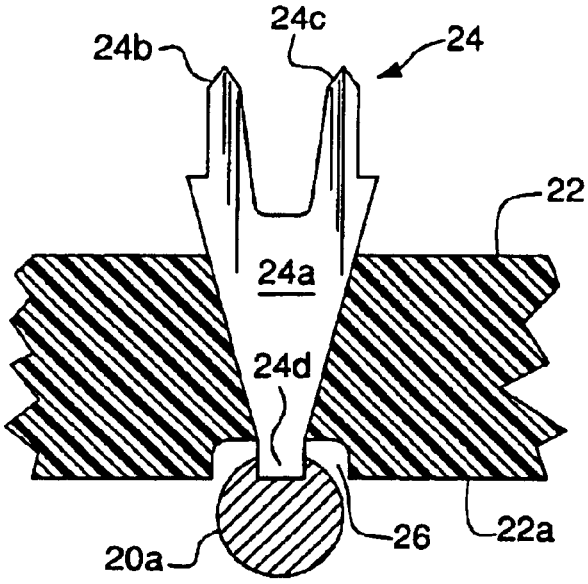
FIG. 9 is a side view of a signal contact of the receptacle shown in FIGS. 1–3 and 6, depicting the signal contact mounted in the receptacle.
Figure 10:
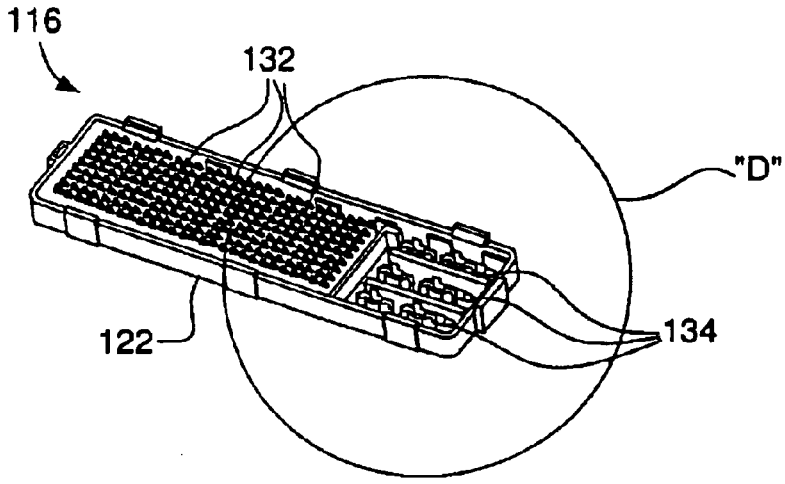
FIG. 10 is a perspective view of an alternative embodiment of the receptacle shown in FIGS. 1–3 and 6.
Figure 11:
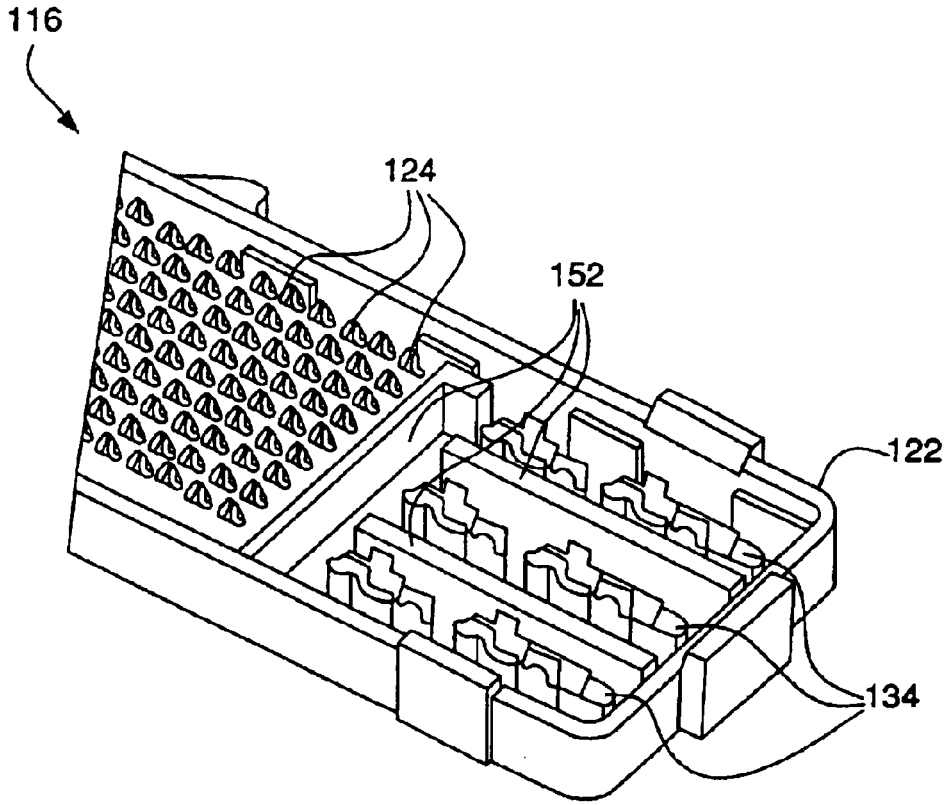
FIG. 11 is a magnified view of the area designated "D" in FIG. 10.
Figure 12:
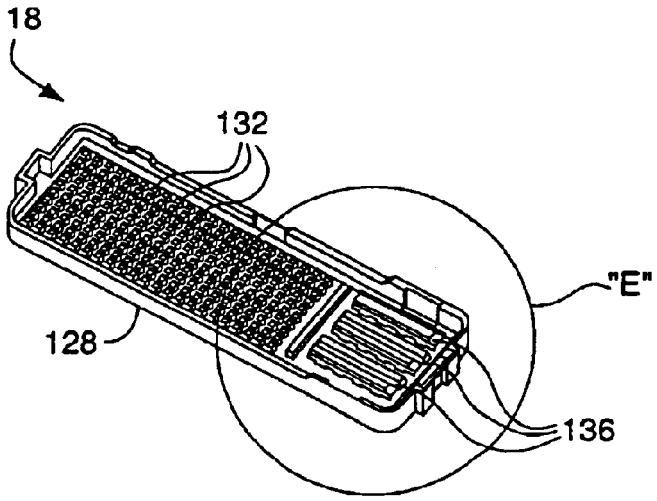
FIG. 12 is a perspective view of an alternative embodiment of the plug shown in FIGS. 1 and 4–6.
Figure 13:
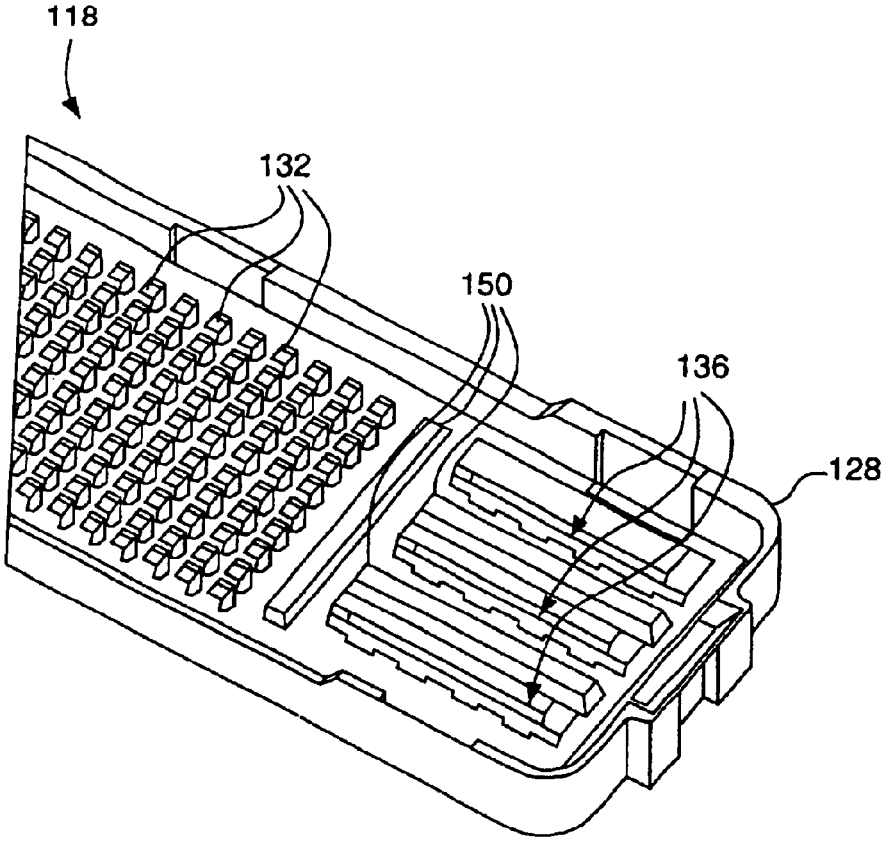
FIG. 13 is a magnified view of the area designated "E" in FIG. 12.
Figure 14:
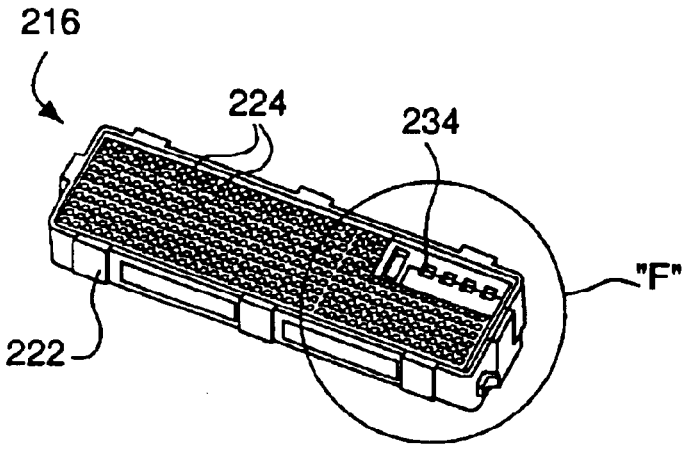
FIG. 14 is a perspective view of another alternative embodiment of the receptacle shown in FIGS. 1–3 and 6.
Figure 15:
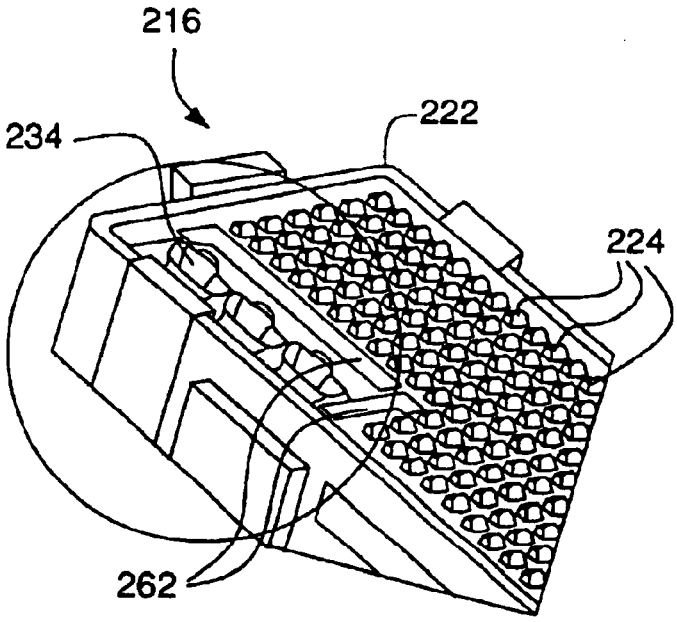
FIG. 15 is a magnified view of the area designated "F" in FIG. 14.
Figure 16:
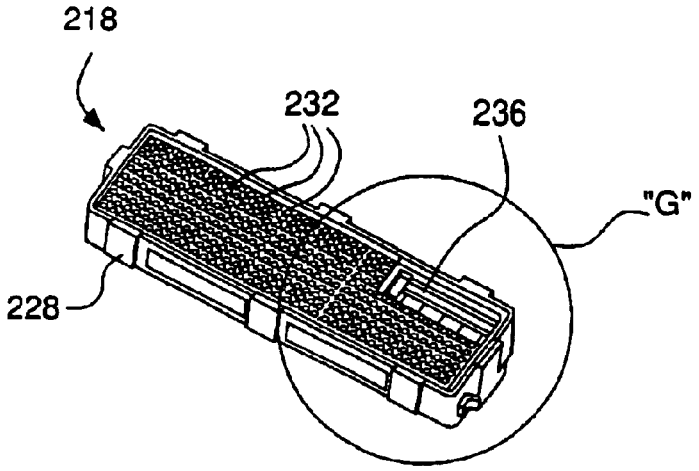
FIG. 16 is a perspective view of another alternative embodiment of the plug shown in FIGS. 1 and 4–6.
Figure 17:
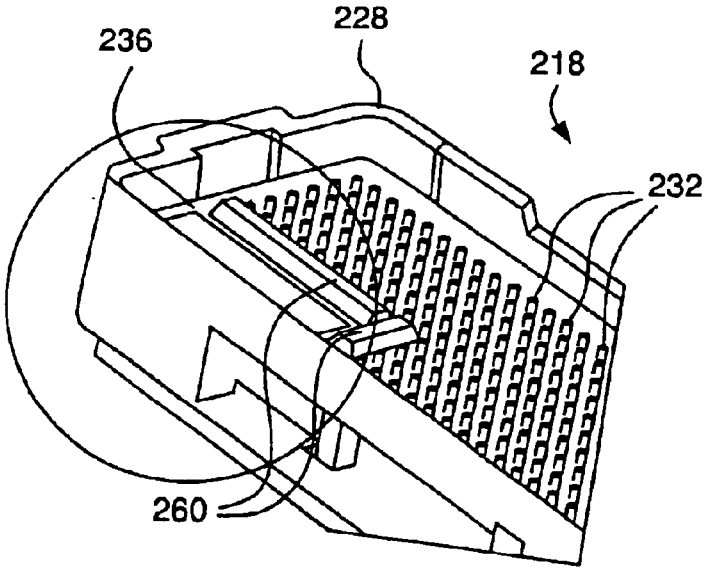
FIG. 17 is a magnified view of the area designated "G" in FIG. 16.
Figure 18:
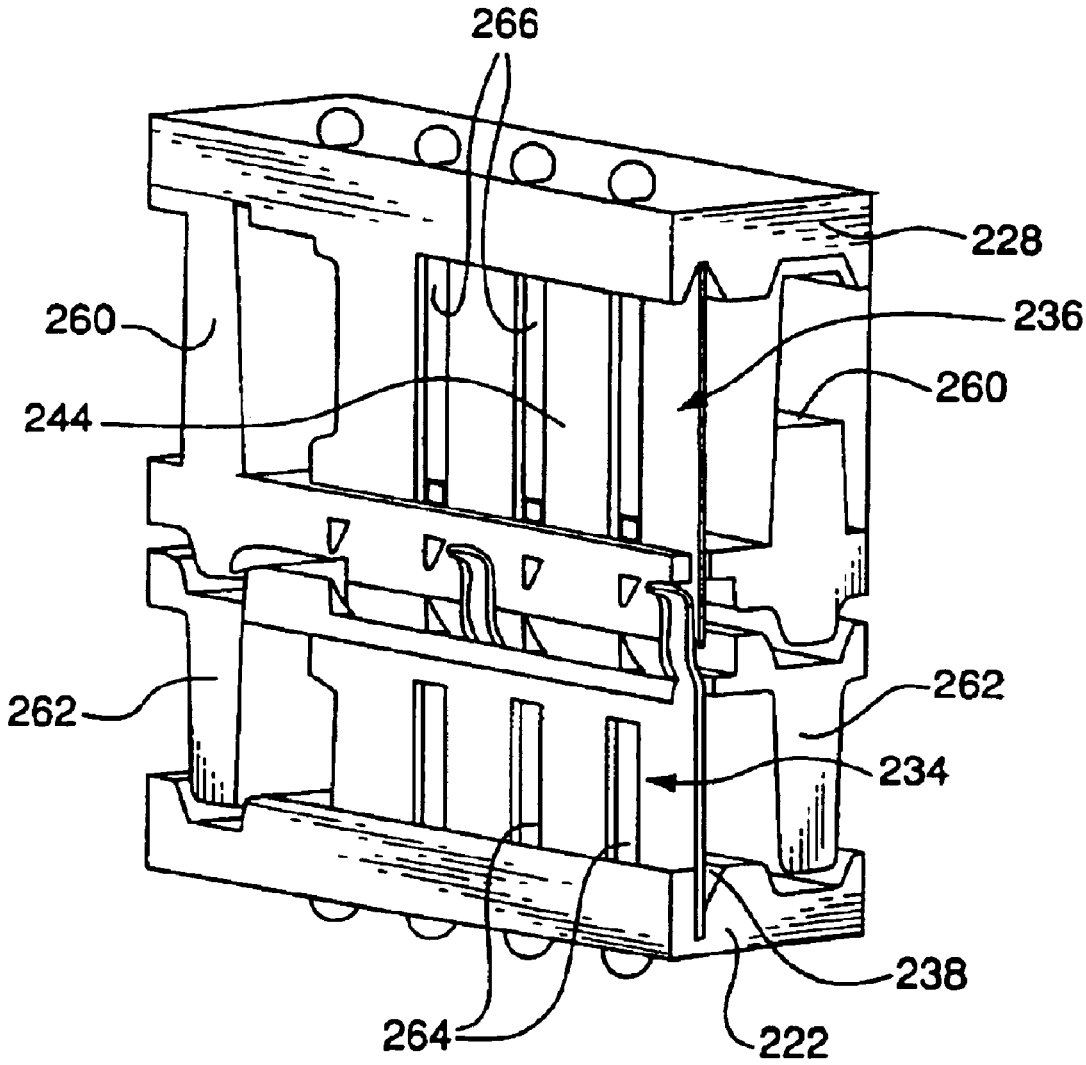
FIG. 18 is a cross-sectional view of the areas designated "H" in FIG. 15 and "I" in FIG. 16, with the receptacle and plug shown in a mated condition.

The receptacle 16 preferably comprises an array of fusible elements such as solder balls 20*a* (see FIGS. 6 and 9). The receptacle 16 can be mounted on the first PCB 12 by aligning each solder ball 20*a* with a corresponding electrical-connection point, such as an electrical-connection pad 19, on the first PCB 12, and re-flowing the solder balls 20*a*. (The electrical-connection pads 19 are depicted diagrammatically in FIG. 1.)

Figure 8:
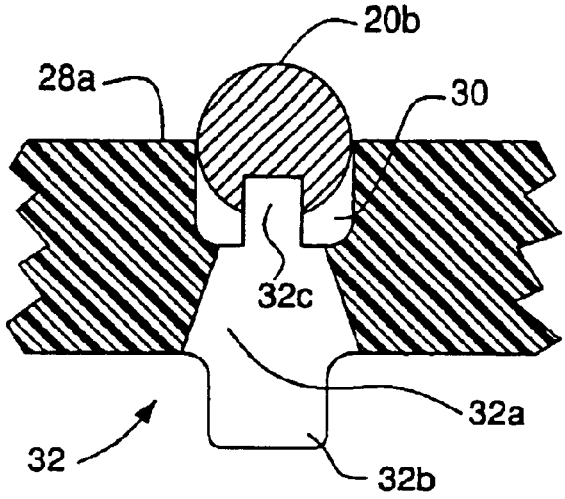
FIG. 8 is a side view of a signal contact of the plug shown in FIGS. 1 and 4–6, depicting the signal contact mounted in the plug.

The plug 18 comprises an array of fusible elements such as solder balls 20*b* (see FIGS. 6 and 8). The plug 18 can be mounted on the second PCB 14 by aligning each solder ball 20*b* with a corresponding electrical-connection point, such as an electrical-connection pad 21, on the second PCB 14, and re-flowing the solder balls 20*b*. (The electrical-connection pads 21 are depicted diagrammatically in FIG. 1.)

It should be noted that the used of the above-described mounting arrangements for the receptacle 16 and the plug 18 are described for exemplary purposes only. Other types of mounting arrangements can be used in alternative embodiments, including mounting arrangements that do not incorporate fusible elements such as the solder balls 20*a*, 20*b*.

The receptacle 16 comprises a receptacle body 22 formed from a suitable dielectric material (see FIGS. 2, 3, 6, and 9). The receptacle body 22 includes a major surface 22*a* having a plurality of recesses 26 formed therein (see FIGS. 6 and 9). Each recess 26 accommodates a portion of a respective solder ball 20*a*. The receptacle 16 also comprises a plurality of electrically-conductive signal contacts 24 (see FIG. 9). The signal contacts are mounted on, and extend through, the receptacle body 22. The signal contacts 24 are arranged in six rows each having forty of the signal contacts 24 therein, and four rows each having twenty-eight of the signal contacts 24 therein (see FIG. 2).

Each signal contact 24 has a substantially flat mounting portion 24*a*, and a first and a second contact beam 24*b*, 24*c* that adjoin the mounting portion 24*a* (see FIG. 9). Each signal contact 24 also comprises an attachment tab 24*d* that adjoins the mounting portion 24*a*. The mounting portion 24*a*, first and second contact beams 24*b*, 24*c*, and attachment tab 24*d* are preferably formed on a unitary basis.

The signals contacts 24 are each mounted in the receptacle body 22, as shown in FIG. 9. More particularly, the body portion 24*a* of each signal contact 24 is mounted in the body so that the first and second contact beams 24*b*, 24*c* extend upward from the receptacle body 22 (from the perspective of FIG. 9), and the attachment tab 24*d* is positioned in a corresponding one of the recesses 26. The attachment tab 24*d* is fused to a respective one of the solder balls 20*a*. The solder ball 20*a* helps to retain the contact 24 in the receptacle body 22 before the receptacle 16 is mounted on the first PCB 12.

The plug 18 comprises a plug body 28 formed from a suitable dielectric material (see FIGS. 1, 4, 5, 6, and 8). The plug body 28 includes a major surface 28*a* having a plurality of recesses 30 formed therein (see FIGS. 6 and 8). Each recess 30 accommodates a portion of a respective solder ball 20*b*. The plug 18 also comprises a plurality of electrically-conductive signal contacts 32 (see FIG. 8). The signal contacts 32 are mounted on, and extend through the plug body 28. The signal contacts 32 are arranged in six rows each having forty of the signal contacts 32 therein, and four rows each having twenty-eight of the signal contacts 32 therein (see FIG. 4).

Each signal contact 32, as explained below, engages a corresponding signal contact 24 when the receptacle 16 and the plug 18 are mated. Each corresponding pair of signal contacts 24, 32 conducts electrical signals between the first and second PCBs 12, 14 when the receptacle 16 and the plug 18 are mated.

Each signal contact 32 has a substantially flat mounting portion 32*a*, and a substantially flat mating portion 32*b* that adjoins the mounting portion 32*a* (see FIG. 8). Each signal contact 32 also comprises an attachment tab 32*c* that adjoins the mounting portion 32*a*. The mounting portion 32*a*, mating portion 32*b*, and attachment tab 32*c* are preferably formed on a unitary basis.

The signal contacts 32 are each mounted on the plug body 28. More particularly, the mounting portion 32*a* of each signal contact 32 is mounted in the plug body 28 so that the mating portion 32*b* extends downward from the plug body 28 (from the perspective of FIG. 8), and the attachment tab 32*c* is positioned in a corresponding one of the recesses 30. The attachment tab 32*c* is fused to a respective one of the solder balls 20*b*. The solder ball 20*b* helps to retain the signal contact 32 in the plug body 28 before the plug 18 is mounted on the second PCB 14.

The receptacle body 22 of the receptacle 16 has mating features 22*b* formed thereon, and the plug body 28 of the plug 18 has mating features 28*b* formed thereon (see FIGS. 2–6). The mating features 22*b*, 28*b* are complementary. In other words, each mating feature 22*b* on the receptacle body 22 engages a corresponding mating feature 28*b* on the plug body 28 to maintain the receptacle 16 and the plug 18 in proper alignment during mating thereof.

Each signal contact 24 engages a respective signal contact 32 when the receptacle 16 and the plug 18 are mated, as noted above. More particularly, the receptacle 16 and plug 18 are configured so that each signal contact 24 substantially aligns with a corresponding signal contact 32 during mating of the receptacle 16 and plug 18. Relative movement of the signal contact 24 toward the signal contact 32 during mating of the receptacle 16 and the plug 18 causes the first and second contact beams 24*b*, 24*c* to engage opposing sides the mating portion 32*b*.

Further relative movement of the signal contact 24 toward the signal contact 32 causes the mating portion 32*b* to become disposed between the first and second contact beams 24*b*, 24*c*. Insertion of the mating portion 32*b* between the first and second contact beams 24*b*, 24*c* causes the first and second contact beams 24*b*, 24*c* to resiliently deflect in opposite directions substantially perpendicular to the direction of insertion.

The resilience of first and second contact beams 24*b*, 24*c* biases the first and second contact beams 24*b*, 24*c* against the mating portion 32*b*, and causes the first and second contact beams 24*b*, 24*c* to wipe the mating portion 32*b* as the receptacle 16 and the plug 18 are mated. The bias and the wiping effect of the first and second contact beams 24*b*, 24*c* can enhance the electrical connection between the signal contacts 24, 32.

The receptacle 16 further comprises a first electrically-conductive member, and the plug 18 further comprises a second electrically-conductive member. The first and second electrically-conductive members conduct electrical power between the first and second PCBs 12, 14 when the receptacle 16 and the plug 18 are mated. The first conducting member can be, for example, a power contact strip 34, and the second conducting member can be, for example, a power contact strip 36 (see FIGS. 2–7).

Figure 7:
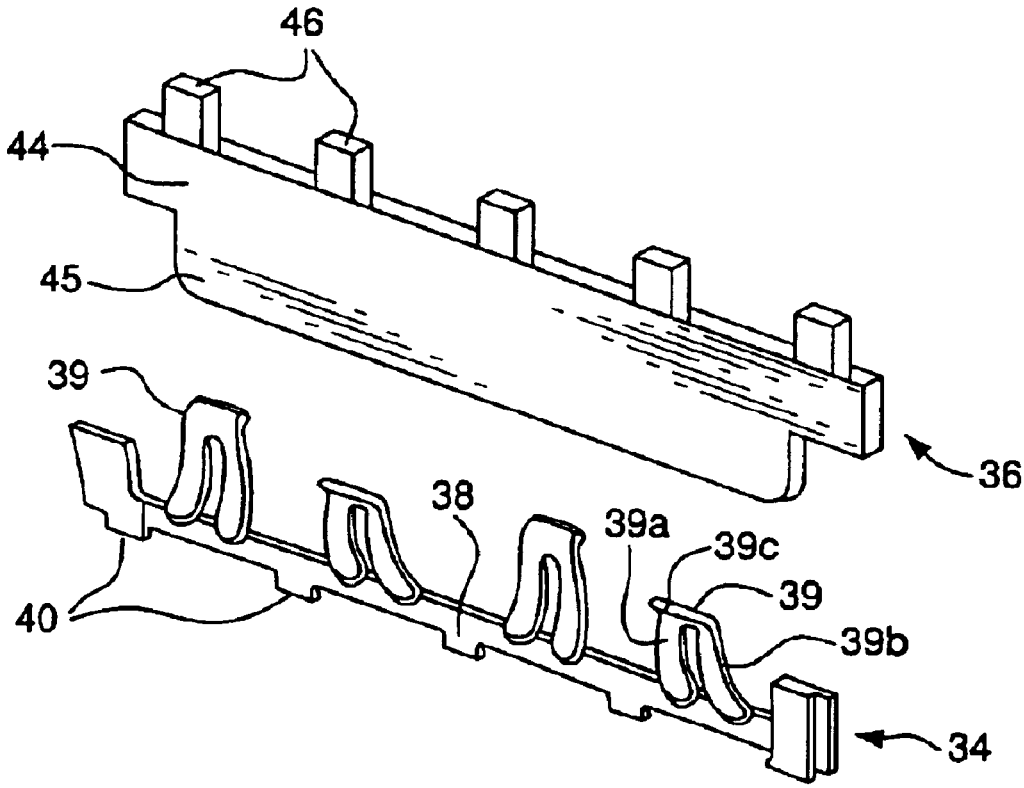
FIG. 7 is a perspective view of a power contact strip of the receptacle shown in FIGS. 1–3 and 6, and a power contact strip of the plug shown in FIGS. 1 and 4–6, in an un-mated condition.

The power contact strip 34 preferably comprises a substantially flat and elongated body portion 38 (see FIG. 7). The power contact strip 34 also comprises mating features and attachment features. The mating features can be, for example, a plurality of mating tabs 39 and the attachment features can be, for example, a plurality of attachment tabs 40. Although the power strip 34 is shown as comprising four of the mating tabs 39 and five of the attachment tabs 40, these numbers can be varied in alternative embodiments to increase the power-handling capacity of the power strip 34.

The body portion 38, mating tabs 39, and, attachment tabs 40 are preferably formed unitarily. The mating tabs 39 extend upward from the body portion 38, and the attachment tabs 40 extend downward from the body portion 38 (from the perspective of FIG. 7). The mating tabs 39 and attachment tabs 40 are preferably staggered. In other words, the mating tabs 39 and attachment tabs 40 are offset so that the mating tabs 39 do not align with the attachment tabs 40 in the vertical direction, as depicted in FIG. 7. The significance of this feature is discussed below.

Each mating tab 39 preferably comprises a first and a second beam portion 39*a*, 39*b* that adjoin the body portion 38, and a tab portion 39*c* that adjoins the first and a second beam portions 39*a*, 39*b*. The first and second beam portions 39*a*, 39*b* and the tab portion 39*c* are preferably curved as depicted in FIG. 7. The orientations of adjacent mating tabs 39 are substantially reversed. In other words, the curvature of the first and second beam portions 39*a*, 39*b* and the tab portion 39*c* of adjacent mating tabs 39 are substantially reversed.

The power contact strip 34 is mounted on the receptacle body 22 of the receptacle 16. More particularly, the body portion 38 is mounted in a slot 43 formed in the receptacle body 22 (see FIGS. 3 and 6) so that the mating tabs 39 extend upwardly from the receptacle body 22 (from the perspective of FIGS. 2 and 3). Each attachment tab 40 extends into a respective one of the recesses 26 by way of a through hole (not shown) formed in the receptacle body 22. A respective one of the solder balls 20*a* is fused to each of the attachment tabs 40. The solder balls 20*a* help to retain the power contact strip 34 in the slot 43 before the receptacle 16 is mounted on the first PCB 12.

Each solder ball 20*a* is aligned with a corresponding electrical-connection pad 19 on the first PCB 12, and is re-flowed to establish a solder connection 55 between the corresponding attachment tab 40 and the electrical-connection pad 19. (The solder connections 55 are depicted diagrammatically in FIG. 1.) The solder connections 55 establish electrical contact between the power contact strip 34 and the first PCB 12, and help to retain the receptacle 16 on the first PCB 12.

Projections 53 can be formed on the surfaces of the receptacle body 22 that define the slot 43 (see FIG. 6). Four of the projections 53 (two on each side of the slot 43) are associated with each of the recesses 26, and are offset from the associated recess 26 as shown in FIG. 6. The projections 53 are thus positioned on either side of the respective areas on the body portion 38 that adjoin the attachment tabs 40. This feature is believed to reduce mechanical stresses in the solder connections 55, as explained in detail below.

The power contact strip 36 preferably comprises a body portion 44 (see FIG. 7). The power strip 36 also comprises mating features and attachment features. The mating features can be, for example, a contact blade 45, and the attachment features can be, for example, a plurality of attachment tabs 46. The body portion 44 and contact blade 45 each have a substantially flat and elongated configuration as shown in FIG. 7. The body portion 44, contact blade 45, and attachment tabs 46 are preferably formed unitarily. The contact blade 45 extends downward from the body portion 44, and the attachment tabs 46 extend upward from the body portion 44 (from the perspective of FIG. 7).

The power contact strip 36 is mounted on the plug body 28 of the plug 18. More particularly, the body portion 44 is mounted in a slot 49 formed in the plug body 28 (see FIGS. 5 and 6) so that the contact blade 45 extends upwardly from the plug body 28 (from the perspective of FIGS. 4 and 5). Each attachment tab 46 extends into a respective one of the recesses 26 by way of a through hole (not shown) formed in the receptacle body 22. A respective one of the solder balls 20*b* is fused to each of the attachment tabs 46. The solder balls 20*b* help to retain the power contact strip 36 in the slot 49 before the plug 18 is mounted on the PCB 14.

Each solder ball 20*b* is aligned with a corresponding electrical-connection pad 21 on the second PCB 16, and is re-flowed to establish a solder connection 57 between the corresponding attachment tab 46 and the electrical-connection pad 21. (The solder connections 57 are depicted diagrammatically in FIG. 1). The solder connections 57 establish electrical contact between the power contact strip 36 and the second PCB 14, and help to retain the plug 18 on the second PCB 14.

Projections 51 can be formed on the surfaces of the plug body 28 that define the slot 49 (see FIG. 6). Four of the projections 51 (two on each side of the slot 49) are associated with each of the recesses 30, and are offset from the associated recess 30 as shown in FIG. 6. The projections 51 are thus positioned on either side of the respective areas on the body portion 44 that adjoin the attachment tabs 48. This feature is believed to reduce mechanical stresses in the solder connections 57, as explained in detail below.

The power contact strip 34, and in particular the mating tabs 39, act as a receptacle that receives the contact blade 45 of the power contact strip 36. More specifically, the receptacle 16 and plug 18 are configured so that the mating tabs 39 of the power contact strip 34 substantially align with the contact blade 45 of the power contact strip 36 as the receptacle 16 and the plug 18 are mated. Relative movement of the mating tabs 39 toward the contact blade 45 causes the contact blade 45 to contact the tab portions 39*c* of the mating tabs 39.

The contact between the contact blade 45 and the tab portions 39*c*, in conjunction with the relative movement of the mating tabs 39 toward the contact blade 45, cause the mating tabs 39 to resiliently deflect. The orientations of adjacent mating tabs 39 are substantially reversed, as noted above. This feature causes adjacent mating tabs 39 to contact opposing sides of the contact blade 45. Moreover, the adjacent mating tabs 39 deflect in substantially opposite directions, each substantially perpendicular to the direction of relative movement between the receptacle 16 and the plug 18.

The resilience of the first and second beam portions 39*a*, 39*b* biases the tab portions 39*c* against the contact blade 45, and causes the tab portions 39*c* to wipe the contact blade 45 as the receptacle 16 and the plug 18 are mated. The bias and the wiping effect of the mating tabs 39 can enhance the electrical connection between the power contact strips 34, 36.

The mating tabs 39 and the attachment tabs 40 on the power contact strip 34 are preferably staggered, as discussed above. This feature is believed to substantially reduce mechanical stresses in the attachment tabs 40 (and in the solder connections 55 attached thereto). More particularly, the resilient deflection of the mating tabs 39 caused by the engagement of the mating tabs 39 and the contact blade 45 is believed to induces stresses in the body portion 38 directly below the mating tabs 39 (from the perspective of FIG. 7). In other words, the areas on the body portion 38 located directly below the mating tabs 39 are high-stress areas. Staggering the mating tabs 39 and the attachment tabs 40 locates the attachment tabs 40 away from these high-stress areas.

Alleviating mechanical stresses in the attachment tabs 40 can reduce the mechanical stresses in the solder connections 55, and can thus increase the reliability and the useful life of the solder connections 55.

The projections 53 formed on the receptacle body 22 are also believed to reduce stresses in the solder connections 55, as noted above. The projections 53 restrain the body portion 38 when the mating tabs 39 engage the contact blade 45 and deflect. The projections 53, as explained previously, are positioned on either side of the respective areas on the body portion 38 that adjoin the attachment tabs 40. The restraint exerted by the projections 53 can therefore reduce or eliminate twisting of the body portion 38 proximate the attachment tabs 40 in response to the resilient deflection of the mating tabs 39. In other words, the projections 53 permit the mating tabs 39 to resiliently deflect without inducing a substantial moment (and the accompanying mechanical stresses) on the neighboring attachment tabs 40, or on the solder connections 55 attached thereto.

The projections 51 formed on the plug body 28 are believed to reduce or eliminate mechanical stresses in the solder connections 57, in a manner substantially similar to that described above with respect to the projections 53. More particularly, the projections 51 restrain the body portion 44 of the power contact strip 36 from twisting substantially in response to the engagement of the contact blade 45 and the mating tables 39, and can thereby alleviate the mechanical stresses that would otherwise occur in the solder connections 57 as a result of such twisting.

Figure 4:
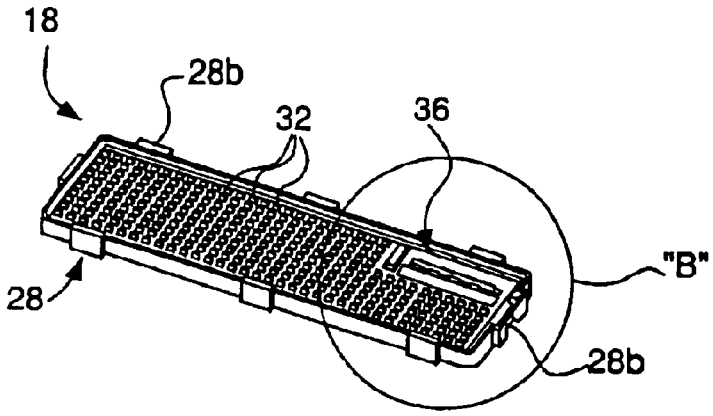
FIG. 4 is a perspective view of the plug shown in FIG. 1.
Figure 5:
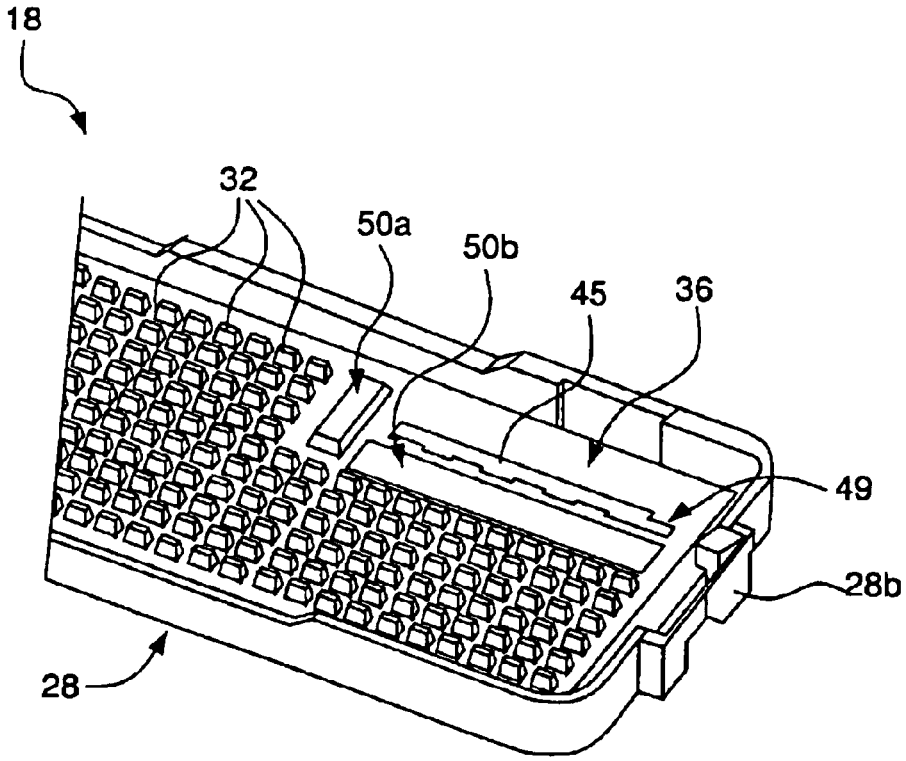
FIG. 5 is a magnified view of the area designated "B" in FIG. 4.

The plug body 28 of the plug 18 can have a first and a second barrier 50*a*, 50*b* formed thereon (see FIGS. 4 and 5). The first and second barriers 50*a*, 50*b* are positioned substantially between the power contact strip 36 and the adjacent signal contacts 32. The first and second barriers 50*a*, 50*b* are preferably formed unitarily with the remainder of the plug body 28.

Figure 1:
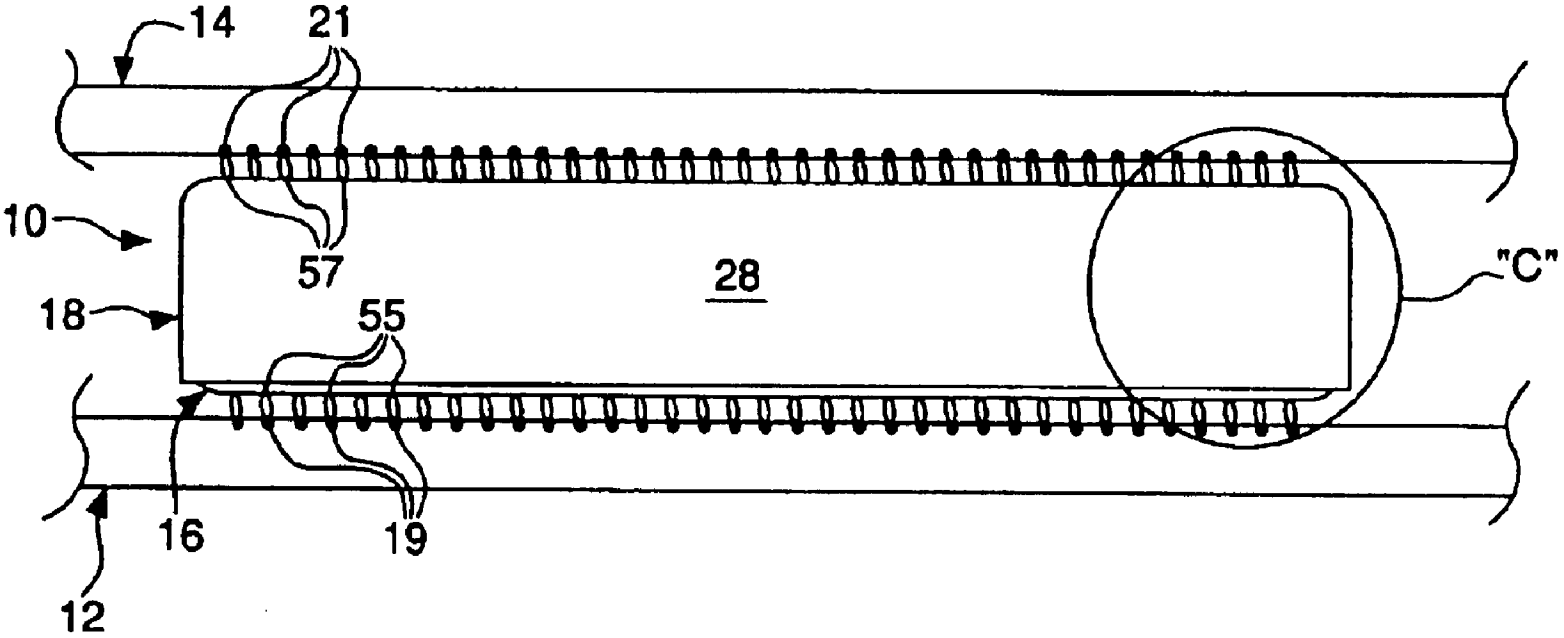
FIG. 1 is a diagrammatic side view of a preferred embodiment of a mezzanine-type electrical connector mounted on a first and a second circuit substrate, with a receptacle and a plug of the electrical connector in a mated condition.
Figure 2:
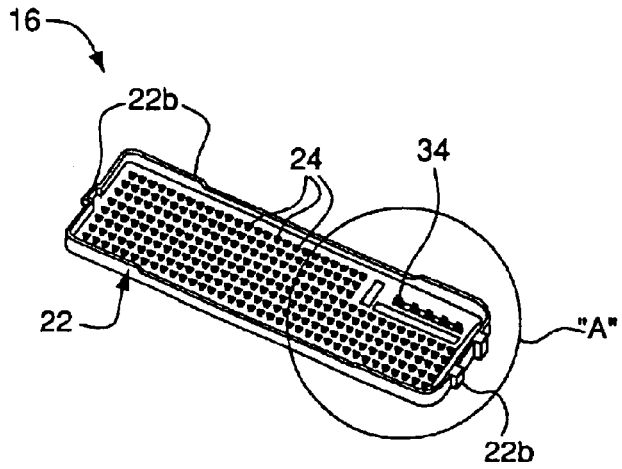
FIG. 2 is a perspective view of the receptacle shown in FIG. 1.
Figure 3:
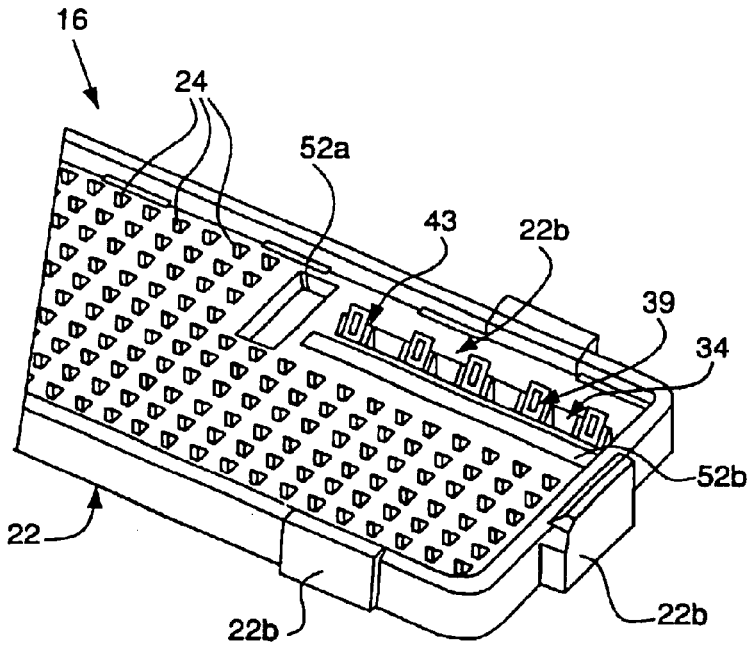
FIG. 3 is a magnified view of the area designated "A" in FIG. 2.

The receptacle body 22 of the receptacle 16 can have a first and a second recess 52*a*, 52*b* formed therein (see FIGS. 2 and 3). The first and second recesses 52*a*, 52*b* are positioned substantially between the power contact strip 34 and the adjacent signal contacts 24.

The shape of the first recess 52*a* is substantially similar to that of the first barrier 50*a*, and the shape of the second recess 52*b* is substantially similar to that of the second barrier 50*b*. The first and second recesses 52*a*, 52*b* receive the respective first and second barriers 50*a*, 50*b* when the receptacle 16 and the plug 18 are mated.

The barriers 50*a*, 50*b* are believed to electrically isolate (or further isolate) the signal contacts 24, 32 from the power contact strips 34, 36. Hence, the barriers 50*a*, 50*b* can potentially reduce signal degradation in the signal contacts 24, 32 due to the comparatively high voltage in the power contact strips 34, 36. (This feature is particularly advantageous, and may be mandatory, in applications in which the voltage level in the power contact strips 34, 36 is relatively high, e.g., 50 volts or greater.)

It should be noted that the receptacle body 22 of the receptacle 16 can be equipped with the barriers 50*a*, 50*b*, and the recesses 52*a*, 52*b* can be formed in the plug body 28 of the plug 18 in alternative embodiments.

Power is transferred through the connector system 10 by way of the power contact strips 34, 36, as discussed above. This feature can provide substantial advantages in relation to conventional mezzanine-type electrical connector systems. For example, the use of the power contact strips 34, 36 is believed to substantially increase the voltage and current-carrying capacities of the connector system 10 in relation to conventional mezzanine-type connector systems in which power is transferred through individual contacts.

Moreover, transferring power through one or more power contact strips spaced apart from the signal contacts, as in the connector system 10, can substantially reduce the potential for signal degradation caused by the relatively high voltages in the power-conducting paths. (The signal contacts 24, 32 of the connector system 10, as discussed above, can be further isolated from the power contact strips 34, 36 through the use of the barriers 50*a*, 50*b*.)

It is to be understood that even though numerous characteristics and advantages of the present invention have been set forth in the foregoing description, the disclosure is illustrative only and changes may be made in detail within the principles of the invention to the full extent indicated by the broad general meaning of the terms in which the appended claims are expressed. For example, specific details of the receptacle 16 and the plug 18, such as the number, arrangement, and configuration of the signal contacts 24, 32, have been presented for exemplary purposes only. The principles of the invention can be applied to virtually any type of mezzanine-type electrical connector.

An alternative embodiment of the connector system 10 is depicted in FIGS. 10 to 13. The alternative embodiment comprises a receptacle 116 that includes three power contact strips 134, and a plug 118 that includes three of power contact strips 136.

A body 128 of the plug 118 can have three barriers 150 formed thereon between each of the power contact strips 134, and between the power contact strips 134 and a plurality of signal contacts 132 mounted on the body 128. A body 122 of the receptacle 116 can have four recesses 152 formed therein for receiving the barriers 150 when the receptacle 116 and the plug 118 are mated.

Another alternative embodiment of the connector system 10 is depicted in FIGS. 14 to 18. The alternative embodiment comprises a receptacle 216 that includes a power contact strip 234, and a plug 218 that includes a power contact strip 236.

The plug 218 comprises a receptacle body 228, and a barrier 260 positioned between the power contact strip 236 and a plurality of signal contacts 232 of the plug 218. The receptacle 216 comprises a receptacle body 222, and a barrier 262 positioned between the power contact strip 234 and a plurality of signal contacts 224 of the receptacle 216. The barriers 260, 262 are each formed from a suitable dielectric material, and are believed to electrically isolate (or further isolate) the signal contacts 224, 232 from the power contact strips 234, 236.

The power contact strips 234 each comprise a body portion 238 having a plurality of slots 264 formed therein. The slots 264 are believed to enhance the dissipation of heat from the body portion 238, and thus facilitate cooling of the power contact strip 234. The power contact strips 236 each comprise a body portion 244 having a plurality of slots 266 formed therein. The slots 266 are believed to enhance the dissipation of heat from the body portion 244, and thus facilitate cooling of the power contact strip 236.

Moreover, the principles of the invention can be applied to a mezzanine-type plug and receptacle (not shown) that conduct only power using one of more pairs of power contact strips such as the power contact strips 34, 36, i.e., to a mezzanine-type plug and receptacle that do not include any signal contacts.

What is claimed is:

1. A mezzanine-type electrical connector, comprising:

a first connector half for mounting on a first circuit substrate, the first connector half comprising a first connector body, a first plurality of signal contacts mounted in the first connector body for conducting electrical signals, and a first electrically-conductive member mounted in a slot formed in the first connector body for conducting electrical power, the first electrically-conductive member comprising a body portion, attachment features electrically and mechanically coupled to the body portion for electrically and mechanically coupling the first electrically-conductive member to a plurality of locations on the first circuit substrate, and mating features electrically and mechanically coupled to the body portion; and a second connector half for mounting on a second circuit substrate and mating with the first connector half in a direction substantially perpendicular to a major surface of the second substrate, the second connector half comprising a second connector body having a barrier formed from a dielectric material, a second plurality of signal contacts mounted in the second connector body for conducting electrical signals, and a second electrically-conductive member mounted in a slot formed in the second connector body for conducting electrical power, the second electrically-conductive member comprising a body portion, attachment features electrically and mechanically coupled to the body portion of the second electrically-conductive member for electrically and mechanically coupling the second electrically-conductive member to a plurality of locations on the second circuit substrate, and mating features electrically and mechanically coupled to the body portion of the second electrically-conductive member, the barrier being located between the second electrically-conductive member and the second plurality of signal contacts, wherein the mating features of the second electrically-conductive member engage the mating features of the first electrically-conductive member, each of the first plurality of signal contacts mates with a respective one of the second plurality of signal contacts, and the barrier becomes disposed in a recess formed in the first connector body and having a share substantially similar to the shape of the barrier so that the first and second plurality of signal contacts are substantially electrically isolated from the first and second electrically-conductive members when the first and second connector halves are mated.

2. The electrical connector of claim 1, wherein the attachment features of the first electrically-conductive member comprise a first plurality of attachment tabs, the mating features of the first electrically-conductive member comprise a plurality of mating tabs, the attachment features of the second electrically-conductive member comprise a second plurality of attachment tabs, and the mating features of the second electrically-conductive member comprise a contact blade.

3. The electrical connector of claim 2, wherein the first plurality of attachment tabs and the plurality of mating tabs are mechanically coupled to the body portion of the first electrically-conductive member in a staggered arrangement so that each of the first plurality of attachment tabs is offset from each of the plurality of mating tabs.

4. The electrical connector of claim 3, wherein a surface of the first connector body that defines the slot has a plurality of projections formed thereon, the projections being positioned so that each of the projections contacts the body portion of the first electrically-conductive member at a location between locations on the body portion of the first electrically-conductive member where the body portion of the first electrically-conductive member adjoins a respective one of the first plurality of attachment tabs and a respective one of the mating tabs.

5. The electrical connector of claim 2, wherein a total number of the mating tabs is one less than a total number of the first plurality of attachment tabs.

6. The electrical connector of claim 2, wherein:

the first connector half further comprises a first plurality of fusible elements each being fixed to a respective one of the first plurality of attachment tabs for electrically and mechanically coupling the first plurality of attachment tabs to the plurality of locations on the first circuit substrate; and the second connector half further comprises a second plurality of fusible elements each being fixed to a respective one of the second plurality of attachment tabs for electrically and mechanically coupling the second plurality of attachment tabs to the plurality of locations on the second circuit substrate.

7. The electrical connector of claim 2, wherein adjacent ones of the plurality of mating tabs engage opposing sides of the contact blade when the first and second connector halves are mated.

8. A connector system for electrically coupling a first and a second circuit substrate, comprising:

a receptacle for mounting on the first circuit substrate, the receptacle comprising a receptacle body, a first power contact strip mounted in the receptacle body for electrically contacting a first plurality of electrical contact points on the first circuit substrate and conducting electrical power, and a first plurality of signal contacts mounted in the receptacle body for electrically contacting a second plurality of electrical contact points on the first circuit substrate and conducting electrical signals; and a plug for mounting on the second circuit substrate and mating with the receptacle in a direction substantially perpendicular to a major surface of the second substrate the plug comprising a plug body, a second power contact strip mounted in the plug body for electrically contacting a first plurality of electrical contact points on the second circuit substrate and conducting electrical power, and a second plurality of signal contacts mounted in the plug body for electrically contacting a second plurality of electrical contact points on the second circuit substrate and conducting electrical signals, wherein the first power contact strip contacts the second power contact strip and each of the first plurality of signal contacts contacts a respective one of the second plurality of signal contacts when the receptacle and the plug are mated; and one of the receptacle and plug bodies comprises a barrier formed from a dielectric material and located between one of the first and second power contact strips and one of the first and second plurality of signal contacts, and the other of the receptacle and plug bodies has a recess formed therein for receiving the barrier and having a shape substantially similar to a shape of the barrier so that the first and second plurality of signal contacts are substantially electrically isolated from the first and second contact power strips when the receptacle and the plug are mated.

9. The system of claim 8, wherein:

the first power contact strip comprises a body portion, a plurality of mating tabs adjoining the body portion, and a first plurality of attachment tabs adjoining the body portion for electrically contacting the first plurality of electrical contact points; and the second power contact strip comprises a body portion, a contact blade adjoining the body portion of the second power contact strip for engaging the plurality of mating tabs when the receptacle and the plug are mated, and a second plurality of attachment tabs adjoining the body portion of the second power contact strip for electrically contacting the second plurality of electrical contact points.

10. The system of claim 9, wherein the first plurality of attachment tabs and the plurality of mating tabs are mechanically coupled to the body portion of the first power contact strip in a staggered arrangement so that each of the first plurality of attachment tabs is offset from each of the plurality of mating tabs.

11. A connector system for electrically coupling a first and a second circuit substrate, comprising:

a receptacle for mounting on the first circuit substrate and comprising a receptacle body, a first plurality of signal contacts mounted in the receptacle body for conducting electrical signals, and a first power contact strip mounted in a slot formed in the receptacle body for conducting electrical power, the first power contact strip comprising a body portion, a plurality of attachment tabs adjoining the body portion for being electrically and mechanically coupled to respective electrical-connection pads on the first circuit substrate, and plurality of mating tabs adjoining the body portion; and a plug for mounting on the second circuit substrate and mating with the receptacle in a direction substantially perpendicular to a major surface of the second substrate the plug comprising a plug body, a second plurality of signal contacts mounted in the plug body for conducting electrical signals, and a second power contact strip mounted in a slot formed in the plug body for conducting electrical power, the second power contact strip comprising a body portion, a plurality of attachment tabs adjoining the body portion of the second power contact strip for being electrically and mechanically coupled to respective electrical-connection pads on the second circuit substrate, and a contact blade adjoining the body portion of the second power contact strip, wherein the mating tabs engage the contact blade, each of the first plurality of signal contacts contacts a respective one of the second plurality of signal contacts when the plug and the receptacle are mated; and one of the receptacle body and the plug body comprises a barrier formed from a dielectric material and located between one of the first and second power contact strips and one of the first and second plurality of signal contacts, and the other of the receptacle body and the plug body has a recess formed therein and having a shape substantially similar to a share of the barrier for receiving the barrier when the receptacle and the plug are mated.

12. The connector system of claim 11, wherein the attachment tabs of the first power contact strip and the mating tabs are mechanically coupled to the body portion of the first power contact strip in a staggered arrangement so that each of the attachment tabs of the first power contact strip is offset from each of the mating tabs.

13. The connector system of claim 12, wherein a surface of the receptacle body that defines the slot has a plurality of projections formed thereon, the projections being positioned so that each of the projections contacts the body portion of the first power contact strip at a location between locations on the body portion of the first power contact strip where the body portion of the first power contact strip adjoins a respective one of the attachment tabs of the first power contact strip and a respective one of the mating tabs.

14. The connector system of claim 11, wherein:

the receptacle further comprises a first plurality of fusible elements each being fixed to a respective one of the plurality of attachment tabs of the first power contact strip for electrically and mechanically coupling the plurality of attachment tabs of the first power contact strip to the respective electrical-connection pads on the first circuit substrate; and the plug further comprises a second plurality of fusible elements each being fixed to a respective one of the plurality of attachment tabs of the second power contact strip for electrically and mechanically coupling the plurality of attachment tabs of the second power contact strip to the respective electrical-connection pads on the second circuit substrate.

15. The connector system of claim 11, wherein adjacent ones of the plurality of mating tabs engage opposing sides of the contact blade when the receptacle and the plug are mated.

16. The connector system of claim 11, wherein a total number of the mating tabs is one less than a total number of the plurality of attachment tabs of the first power contact strip.

17. A mezzanine-type electrical connector, comprising:

a first connector half for mounting on a first circuit substrate, the first connector half comprising a first connector body, a first plurality of signal contacts mounted in the first connector body for conducting electrical signals, and a first electrically-conductive member mounted in the first connector body for conducting electrical power from a plurality of locations on the first circuit substrate; and a second connector half for mounting on a second circuit substrate and mating with the first connector half in a direction substantially perpendicular to a major surface of the second substrate the second connector half comprising a second connector body a second plurality of signal contacts mounted in the second connector body for conducting electrical signals, and a second electrically-conductive member mounted in the second connector body for conducting electrical power to a plurality of locations on the second circuit substrate, wherein the second power contact strip contacts the first power contact strip and each of the first plurality of signal contacts contacts a respective one of the second plurality of signal contacts when the first and second connector halves are mated; and one of the first and second connector bodies comprises a barrier formed from a dielectric material and located between one of the first and second electrically-conductive members and one of the first and second plurality of signal contacts, and the other of the first and second connector bodies has a recess formed therein and having a shape substantially similar to a shape of the barrier for receiving the barrier when the first and second connector halves are mated.

18. The electrical connector of claim 17, wherein:

the first electrically-conductive member comprises a body portion, a plurality of mating tabs adjoining the body portion, and a first plurality of attachment tabs adjoining the body portion for electrically contacting the plurality of locations on the first circuit substrate; and the second electrically-conductive member comprises a body portion, a contact blade adjoining the body portion of the second power contact strip for engaging the plurality of mating tabs when the first and second connector halves are mated, and a second plurality of attachment tabs adjoining the body portion of the second power contact strip for electrically contacting the plurality of locations on the second circuit substrate.

19. The electrical connector of claim 18, wherein the first plurality of attachment tabs and the plurality of mating tabs are mechanically coupled to the body portion of the first electrically-conductive member in a staggered arrangement so that each of the first plurality of attachment tabs is offset from each of the plurality of mating tabs.

* * * * *